US009301573B2

(12) United States Patent
Jasmine

(10) Patent No.: US 9,301,573 B2
(45) Date of Patent: Apr. 5, 2016

(54) MODULAR FOOTWEAR DISPLAY APPARATUS

(76) Inventor: Elijah Clementy Jasmine, Kenner, LA (US)

( * ) Notice: Subject to any disclaimer, the term of this patent is extended or adjusted under 35 U.S.C. 154(b) by 762 days.

(21) Appl. No.: 13/536,715

(22) Filed: Jun. 28, 2012

(65) Prior Publication Data

US 2013/0008058 A1 Jan. 10, 2013

Related U.S. Application Data

(60) Provisional application No. 61/505,480, filed on Jul. 7, 2011.

(51) Int. Cl.
*A43B 23/24* (2006.01)
*A43B 3/00* (2006.01)

(52) U.S. Cl.
CPC ..... *A43B 23/24* (2013.01); *A43B 3/0005* (2013.01)

(58) Field of Classification Search
CPC .... A43B 3/001; A43B 3/0015; A43B 3/0021; A43B 3/0031; A43B 3/0005; A43B 23/24
USPC ..... 36/132, 136, 137
See application file for complete search history.

(56) References Cited

U.S. PATENT DOCUMENTS

| | | | | |
|---|---|---|---|---|
| 3,473,198 | A * | 10/1969 | Meier | 24/712.3 |
| 4,649,552 | A * | 3/1987 | Yukawa | 377/24 |
| 5,718,021 | A * | 2/1998 | Tatum | 24/712.2 |
| 5,748,087 | A * | 5/1998 | Ingargiola et al. | 340/573.7 |
| 6,122,340 | A * | 9/2000 | Darley et al. | 377/24.2 |
| 6,876,947 | B1 * | 4/2005 | Darley et al. | 702/160 |
| 6,882,955 | B1 * | 4/2005 | Ohlenbusch et al. | 702/160 |
| 2002/0109981 | A1 * | 8/2002 | Amici | 362/103 |
| 2009/0007459 | A1 * | 1/2009 | Barnett | 36/136 |
| 2010/0223815 | A1 * | 9/2010 | McGarity | 36/136 |

* cited by examiner

*Primary Examiner* — Jila M Mohandesi
(74) *Attorney, Agent, or Firm* — Leininger Patents

(57) ABSTRACT

This invention is a removable module for customization of the display of images, animations or videos on footwear. It may synchronize with other like modules for a more dynamic and broader display across multiple pieces of footwear. In addition, it has a unique and sturdy attachment mechanism comprising a L-shaped attachment bar that locks into the data receptacle of the display. This allows stable binding of the module to footwear when in use and rapid attachment and removal.

3 Claims, 9 Drawing Sheets

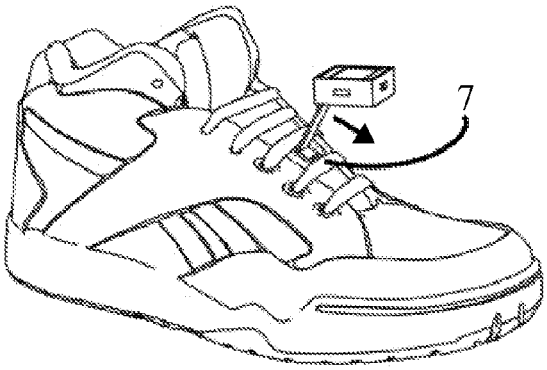
FIG. 4A
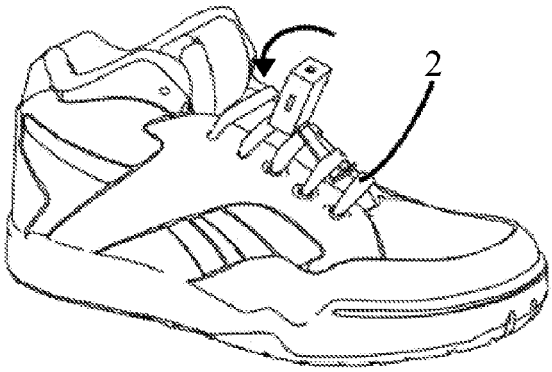
FIG. 4B
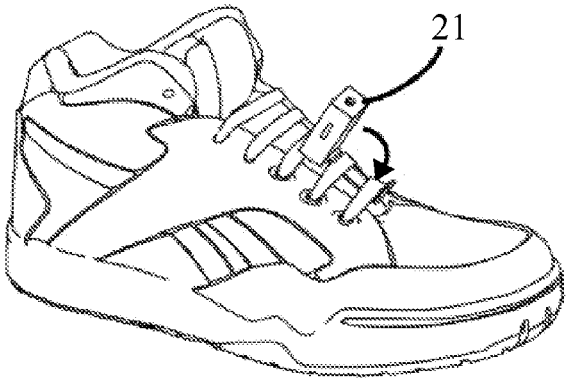
FIG. 4C
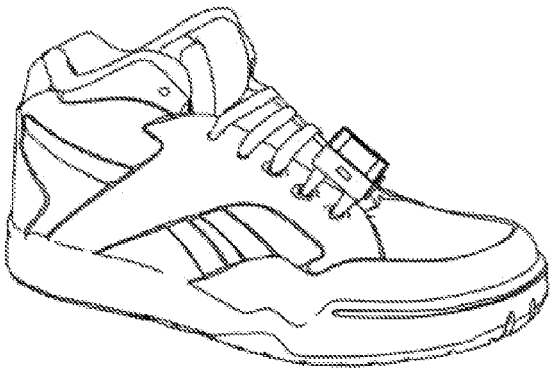
FIG. 4D
FIG. 4

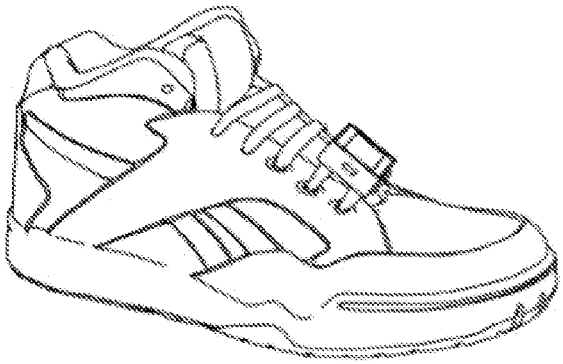
FIG. 5A
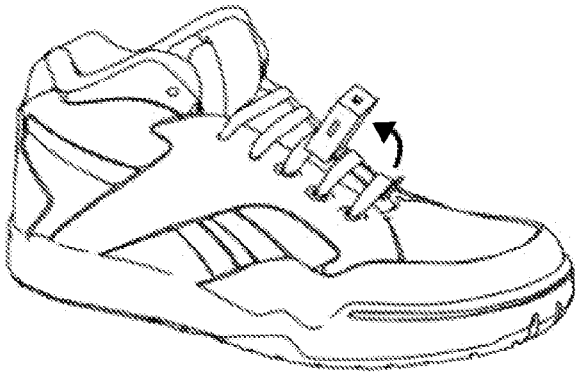
FIG. 5B
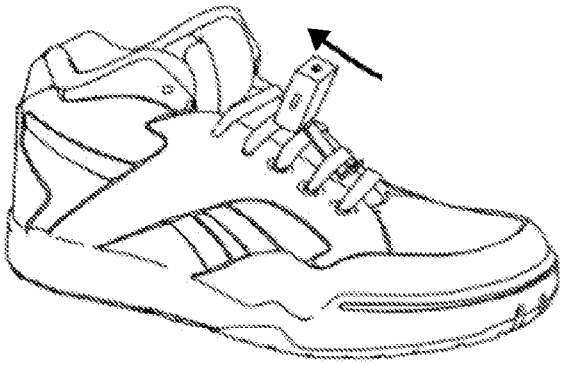
FIG. 5C
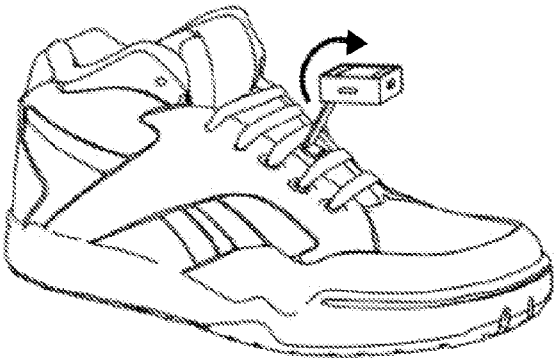
FIG. 5D
FIG 5.

MODULAR FOOTWEAR DISPLAY APPARATUS

CROSS-REFERENCE TO RELATED APPLICATIONS

This application claims a priority benefit to US provisional patent application 2011/61505480.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention is in the technical field of boots, shoes and leggings. More particularly, the present invention is in the technical field of a shoe attachment. More particularly, the present invention is in the technical field of means attached to a foot covering that uses visible radiant energy that is cast back from itself or that originates from itself to make the means visible or cast radiant energy to make the surrounding environment visible.

2. Background of the Art

Customizing and personalizing footwear for either style or utilitarian purposes is a long standing consumer need. Traditional means by which people may customize their footwear, include choosing what styles of shoes to buy, purchasing different lace or placing adornments on shoes such as trinkets or patches. In addition to the these traditional means, there are other more sophisticated means of ornamentation. For example, previous inventions in the art include; a means which to count the pace of steps (U.S. Pat. No. 4,466,204), means for displaying a picture on a shoe (U.S. Pat. No. 4,516,337), a shoe having individualized display areas (U.S. Pat. No. 5,367,795), motion activated illuminating footwear (U.S. Pat. No. 5,408,764), a fixing structure for lightening circuit on a lightening shoe (U.S. Pat. No. 5,490,338), footwear with light emitting diodes (U.S. Pat. No. 5,732,486), footwear with optic fibers (U.S. Pat. No. 5,813,148), sequential flashing footwear (U.S. Pat. No. 5,903,103), lighted athletic shoes (U.S. Pat. No. 6,050,007), footwear with surrounding ornamentation (U.S. Pat. No. 6,957,504), lighted footwear (U.S. Pat. No. 7,497,037), changeable color inserts for shoes (US patent application 2002/0046476), lightening device for a shoe (US patent application 2003/0145494), role playing shoes with sound and light (US patent application 2004/0172856), footwear containing improved audio/visual displays (US patent application 2005/0091884 A1), logo apparatus for shoe (US patent application 2006/00107021), shoe with animated electroluminescent display (US patent application 2006/0198121), interactive shoe light device (US patent application 2007/0041193 A1), footwear with integrated display (US patent application 2010/0223815), footwear for displaying visual content (US patent application 2010/0233816) and a system for customizing footwear (US patent application 2010/0289971). While many of these inventions achieve a desired level of customization, the flexibility of these devices to integrate with existing shoes in a non-destructive, but easily customizable and broadly ornamental manner is limited.

Ornamental modifications to footwear are generally of two types, (1) temporary and removable modification of an existing "normal" shoe that allow customizable adornment or (2) permanent modifications of a special shoe that enable customizable adornment. For those that are temporary and do not involve a permanent modification of the footwear, the inventions are (or involve) an attachment mechanism to the existing shoe. The design of these temporary attachment mechanisms must account for several features according to the desired functionality of the invention including; position on the shoe, strength of attachment to the shoe, surface area that is covered for ornamental display and ease of connecting/removing the attachment.

When considering the placement of such an attachment there are several inventions that have targeted the laces area. This is presumably for several reasons, (1) because laces are taut and lie on but do not bind to the tongue of the shoe, a firm attachment can be bound to the shoe by either lifting and placing the laces within an horizontal groove of a larger solid object, or (2) an object which has holes can be threaded with shoe laces and affixed the to shoe by tightening (3) The laces area can be easily accessed by the person who is wearing the display, (4) The surface area of the laces region is relatively large and is the most visibly accessible from a 360 degree viewing area surrounding the footwear. However, current inventions that bind ornamental attachments to the laces region of shoes have some deficiencies, related to their ease of use.

For example, U.S. Pat. No. 5,844,552 by Valteau, details a detachable foot shield that is affixed to the laces by means of multiple grooves or hooks on the ventral side, while the dorsal side of the shield provides a platform for ornamental display of logos or insignias. While, this is an effective means of binding the object to the laces, individually manipulating the laces to fit in grooves or holes may be considerably time consuming for detachment of the shield. Further, removal of the shield may require the removal of the shoe and laces. Therefore, a means by which both attachment and detachment of a fastening device for ornamental display that is both rapid and secure may be desirable for consumers of such products.

Another patent that target the laces area as a means to securely fasten an object to that region is US patent application 2008/0288317 A1 by Simon. In contrast to the Valteau patent, Simon details an element that is securely fastened under the laces, not above the laces. It has multiple raised sections to simultaneously stabilize the lateral movement of the device and provide support for attached objects on it's dorsal side. The objects remain attached to the footwear by means of an elastic sleeve that surrounds the object that is to be carried.

While 2008/0288317 has an innovative mechanism to secure some types of objects to footwear, there remain some problems associated with the the design of the fastening mechanism and others with it's capability of displaying and modifying ornamental designs on footwear. For example, the presence of three raised sections on the dorsal side of the element, (one at the distal end, one middle section forming a groove near the distal end, and one at the proximal end) also prevent easy removal and of the device from underneath the laces. In particular the raised middle section, while ostensibly forming a groove that stabilizes the element, may also prevent the device from being easily inserted and removed from under the laces. Additionally, the elastic sleeve which is required to bind the nominal object to the base element would likely cover any desired interchangeable ornamental design and thus render the device ineffective for stylistic and personalization that is desired for the footwear.

Yet another application that details an apparatus to attach an ornamental object to the laces portion of footwear is US patent application 2002/0152645 by Darley et al. Darley et al details a detachable foot mount for an electronic device. Similar to the Simon application, it included a mount designed to be covered by the laces, and additionally a detachable housing that interacts with the mount. Similar to the Valteau patent, individually manipulating the laces to fit through the mount may be considerably time consuming for detachment of the entire apparatus from the footwear.

Regarding the display aspect of ornamentation on footwear, again these can be generally placed into two categories, (1) those with adornments that are physically changed by mechanically replacing one design on a particular material with another, such as in U.S. Pat. No. 4,516,337, U.S. Pat. No. 5,367,795, US patent application 2002/0046476 and 2006/00107021 or (2) those with adornments that are dynamically changed by logic-based or programmable light patterns, through the means of bulbs, LED's LCD's or OLED's such as in U.S. Pat. No. 5,408,764, U.S. Pat. No. 5,490,338, U.S. Pat. No. 5,732,486, U.S. Pat. No. 5,813,148, U.S. Pat. No. 5,903,103, U.S. Pat. No. 6,050,007, U.S. Pat. No. 7,497,037, US patent application 2003/0145494, US patent application 2004/0172856, US patent application 2006/0198121, and US patent application 2007/0041193 A1. With regards to increased personalization and dynamically changing ornamentation, attempts to increase the ornamental flexibility and customization options on footwear are reflected in some recent applications. These applications employ employ lighted screens that communicate with integrated circuits to increase the ease with which "adornments" (in this case, images) can be displayed as part of an integrated electronic display on footwear.

One such application is 2010/0223815 by McGarity which details an integrated visual and audio system within a high end shoe. In the main embodiment of this invention, an LCD or plasma screen is integrated into the footwear at the top of the tongue and acts as a personal transportable display device that is integrated within the shoe. While, the integration of an LCD screen into footwear increases the breadth of customization that can be displayed on the footwear, there are several drawbacks to this invention that leave room for innovation.

For example, in order to add variability to the viewing angles and flexibility in the placement of the LCD, McGarity proposes to have one or more of several incorporated elements designed within the shoe including; an attachment mechanism, a rotatable bracket, a locking bar, internal/external gears, sprockets, a pawl and or velcro. The arrangement of such elements, not mentioned in the application, would necessitate a specific shoe in order for the invention to work as proposed (multiple viewing angles, power source, speakers etc.) and thus customization and adornment of non-invention related footwear would be difficult with this invention.

Further, McGarity proposes that the LCD can be reversibly detached from the shoe and attached to other shoes, but does not give details on how this might work without the supporting elements found in the shoe of the invention. Considering the robust mechanical stresses in the foot area and attempts in the field that are specifically concerned with securely attaching objects to footwear, it seems that the unspecified attachment mechanism on footwear not specifically designed for the invention is not a trivial challenge. Further, the placement of the LCD screen at the top of the tongue may be undesirable for several reasons (1) the top of the tongue is in close proximity to the socks of the shoe and as such bacteria may build up on the back side of the LCD display (2) often times the pant leg covers this part of the tongue which may inhibit viewing of the display, (3) when running, the extra wight of the LCD may induce the top of the tongue to flop back and forth, damaging the LCD (4) the close proximity of the LCD to the shin or top of the ankle, may irritate the skin or cause bruising if worn for extended periods of time.

Another such as invention where the display is designed to be incorporated within the footwear is US patent application 2009/0288317 A1 from inventor Forbes. Forbes describes a footwear arrangement comprising "a footwear unit", a programmable display and a controller. This arrangement increases the flexibility of customization options by integrating a programmable display into the shoe, which is operably connected to a controller by means of data cable or wireless connection. Similar to the McGarity invention, Forbes footwear arrangement necessitates a specifically designed shoe in order for the invention to work.

As detailed by Forbes, a footwear unit contains "a window" through which the LCD or LED displayed data is visualized through. Such a window present in the footwear unit, would either necessitate (1) alterations to existing shoes or (2) the manufacturing of a footwear unit specifically designed to incorporate the programmable display within it's window. Further, because of the necessity of having a window within the footwear unit, there is a limit to the practical spatial organization that can be achieved (e.g. number of places upon which the programmable display can arranged on the shoe). For example, specific re-location of the programmable display onto a different area of the same shoe is impractical, because it would require more alterations to the existing shoe (e.g. more windows). With Forbes footwear arrangement, one may have to purchase a large number of similarly styled footwear units with different desired positions of a single window and programmable display in order to achieve a higher level of spatial customization.

Additionally, the footwear arrangement as described by Forbes (and McGarity) is for the specific customization of a single footwear unit by a single programmable display regulated by a single controller. Footwear is nearly always styled in duplicate, with identical features including tongue, laces and affixed designs except that they are mirrored for left and right feet. As such, these inventions do not account for the obvious desire to have two (or more) shoe attached programmable displays function as a synchronized inter-related display unit. There are several ways such a synchronization could be achieved that is not described by Forbes and McGarity, such as (1) having a single controller modify multiple programmable displays through wireless or data cable/port means or (2) have the programmable displays communicate relevant synchronization data, independent of a controller. Considering the likelihood that a person may desire symmetrical style exhibitions or a broader and more interactive ornamental display, the ability to coordinate the time-related behavior of the adornments would likely be a highly desirable function.

Forbes also describes that the programmable display has one or more buttons which are used to interact with a controller or modify the display. While seemingly necessary in order to effect the display, or turn on and off the device, such parameters can be controlled wirelessly via computer or smart phone. If no buttons were in fact present on the programmable display, this would leave the programmable display unencumbered with user interface elements which may be desirable from a fashion perspective. Also, button controlled displays would necessitate the person desiring to change a display pattern or turn off the device to bend down and manipulate the programmable device. Further, buttons may be prone to inadvertent activation by bumping into objects with the footwear. Wireless control of the display parameters would obviate the need for a button(s) and prevent some of the above issues.

In addition, Forbes details that the programmable display is attached to the footwear unit by one of three mechanisms, a carrier, a pocket or an adhesive (in the case of the OLED). While it is necessary to have a means by which to attach the programmable display to the footwear unit, each of these mechanisms would likely be have one or more of the following detriments: an overt carrier or pocket may be stylistically undesirable, these attachment mechanisms may involve permanent modifications to the footwear, they also may be susceptible to failures with rigorous foot movement (running) such as in the case of a pocket or adhesive, running, or leave adhesive attached to the surface of the footwear. An attachment means that was both sturdy and easily transferable between multiple footwear without causing permanent modifications to the footwear would be a desirable innovation.

Forbes also proposes that nominal modifications to the programmable display would engender the display with heat, water or stress resistant properties. However, considering that footwear is regularly subjected to many types of extreme mechanical, heat and moisture related environments and that the proposed display may be include expensive components such as OLED, LCD, wireless sensors, pedometers and global positioning systems, the lack of detail in the specification regarding designs, materials, and/or positioning of elements is not trivial. Rather these details are an important part of the design and enablement of the programmable display itself when it is attached to the footwear unit.

Finally, Forbes suggests that many different sources of power, such as outlets, solar power, etc. . . . are able to power the device. While it is reasonable for the mentioned USB port connected to a computer to replenish a rechargeable battery, home outlets and variable current generating means such as solar power, may require a transformer or detailed circuitry for regulating an acceptable voltage for recharging.

The present invention ponders elimination of the associated deficiencies that are present in the art with respect to the personalization and customization of footwear, by providing stylish, removable, secure and modular footwear display modules that are customizable and synchronizable across non-modified footwear worn by one or multiple persons.

SUMMARY OF THE INVENTION

It is an object of this invention to provide a means to display image based footwear adornments on footwear in a more customizable and dynamic manner. The invention herein allows more customization of footwear appearance with easily manageable control over the display of one or multiple foot display modules.

It is yet another object of this invention to provide a means to synchronize information from multiple modules. This enables a broader, more dynamic and interactive presentation for users of ornamental attachments of footwear.

It is yet another object of this invention to provide a more effective means of rapidly and securely attaching and detaching a display device to the laces of a shoe. This is done by means of a novel attachment bar element having an L-shape. This allows the person using it to easily attach the apparatus underneath the laces and snap it into a data port receptacle, which securely fastens the device to the foot wear and conceals the data port simultaneously.

BRIEF DESCRIPTION OF THE DRAWINGS

FIG. 4 is a composite of images showing the order (from A-D) and mechanism by which attachment of the apparatus to footwear is done.

FIG. 5 is a composite of images showing the order (from A-D) and mechanism by which removal of the apparatus from footwear is accomplished.

DETAILED DESCRIPTION ON THE INVENTION

Figure 1:
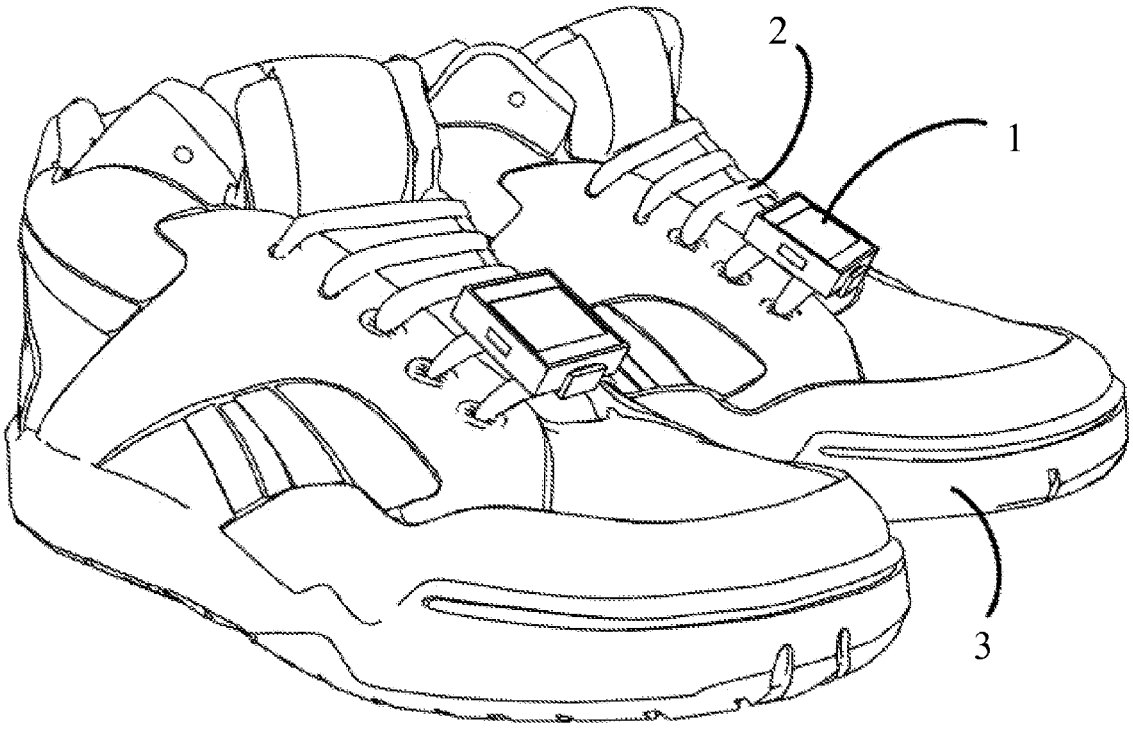
FIG. 1 shows a perspective drawing of two module apparatuses attached to footwear
Figure 2:
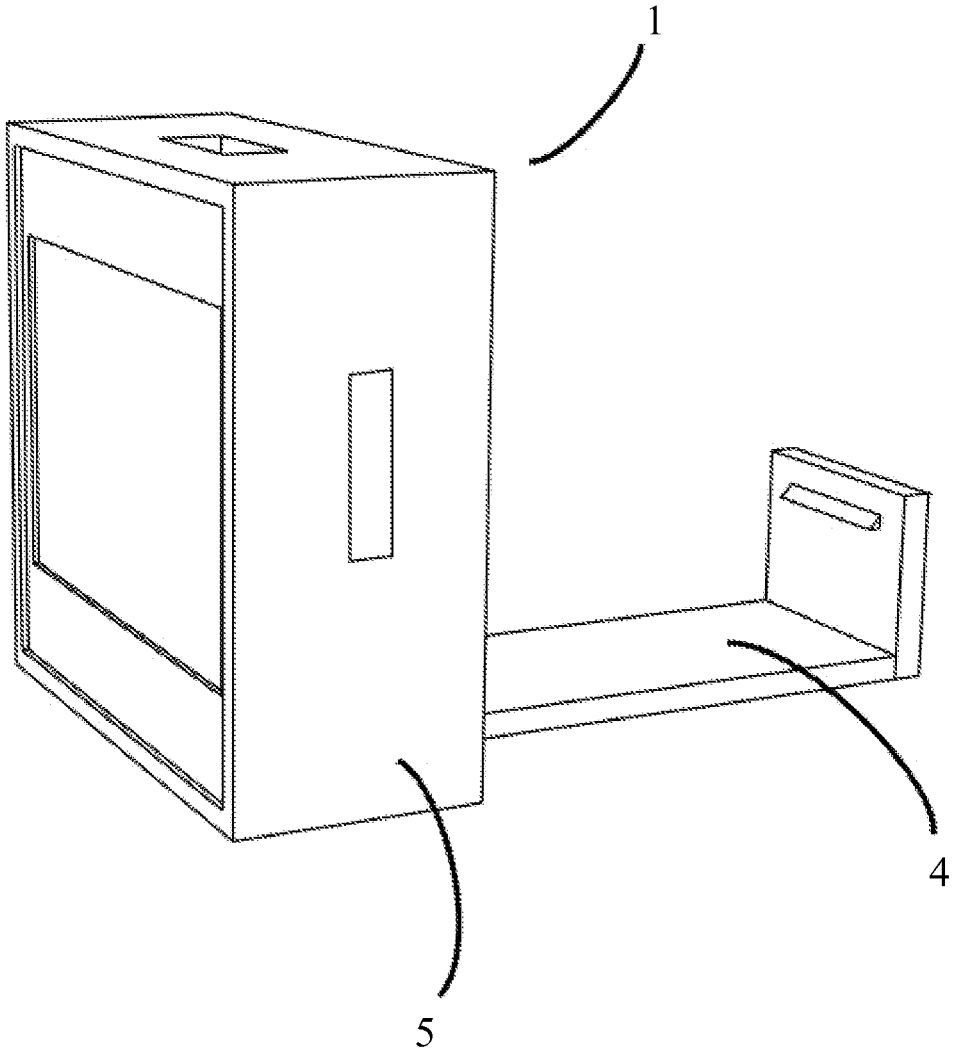
FIG. 2 shows an embodiment of the module apparatus and it's two primary elements; the display element and the attachment bar. In this figure, the attachment bar is in the open position.
Figure 3:
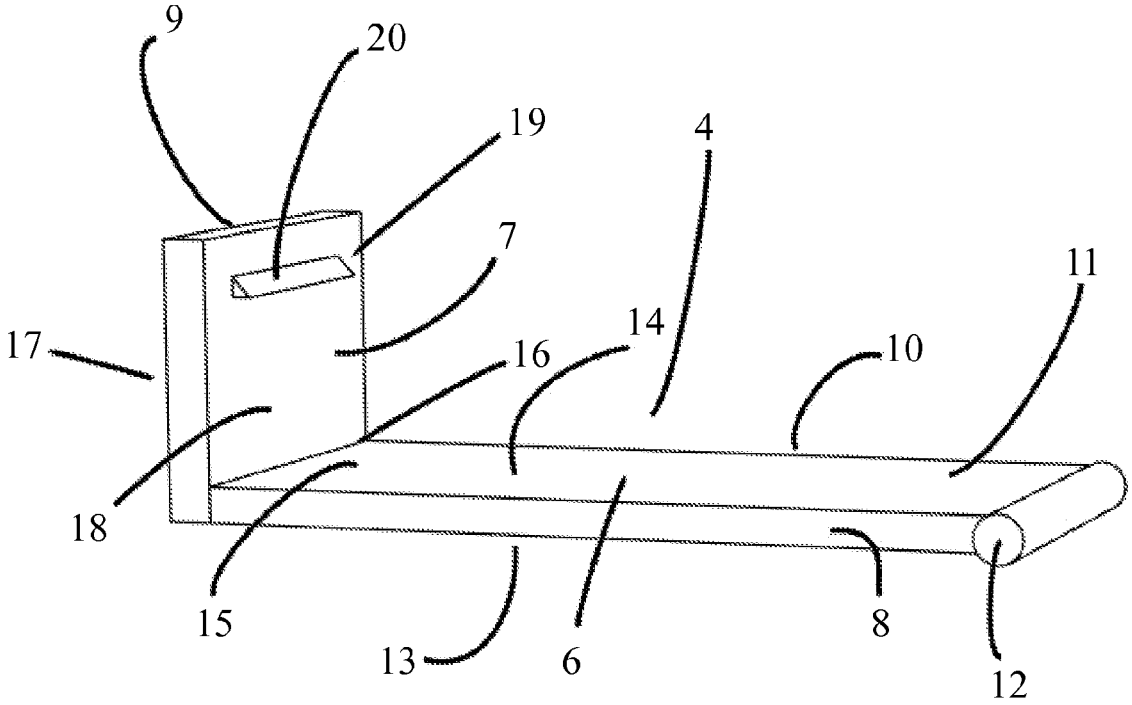
FIG. 3 is a close up view of the attachment bar only, which has many design elements unique for securely attaching a display element to footwear.
Figure 6:
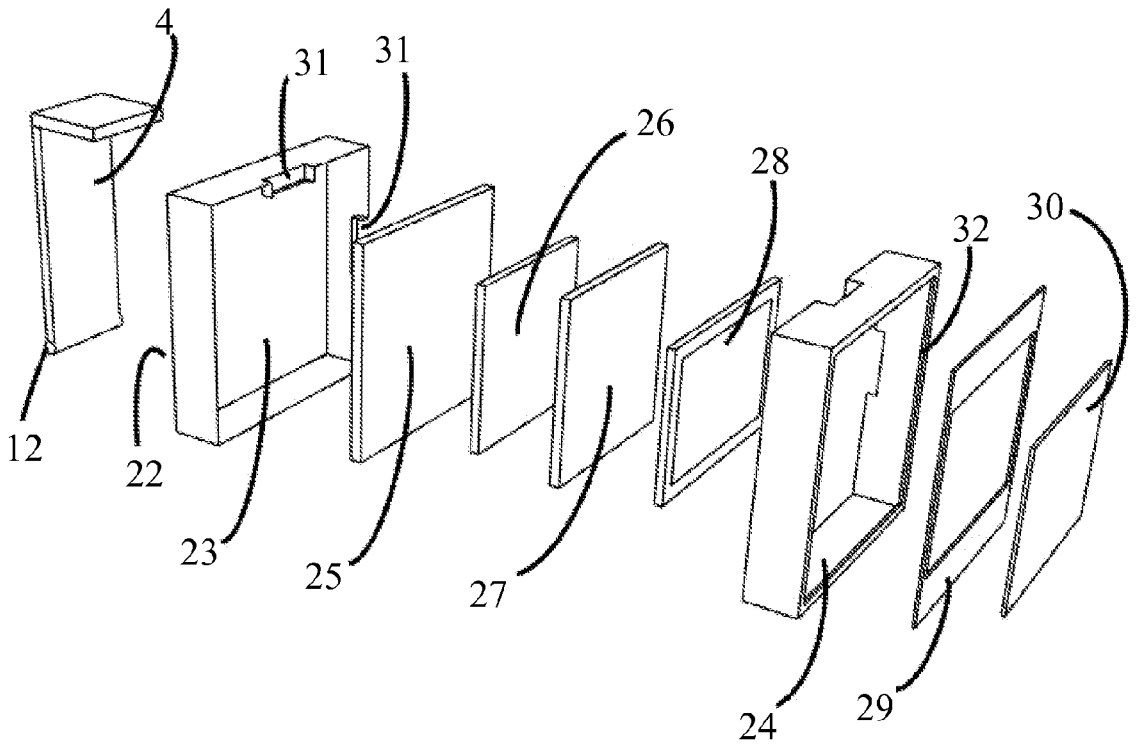
FIG. 6 is an exploded view of the interior elements that are contained within the display element of a module apparatus.
Figure 7:
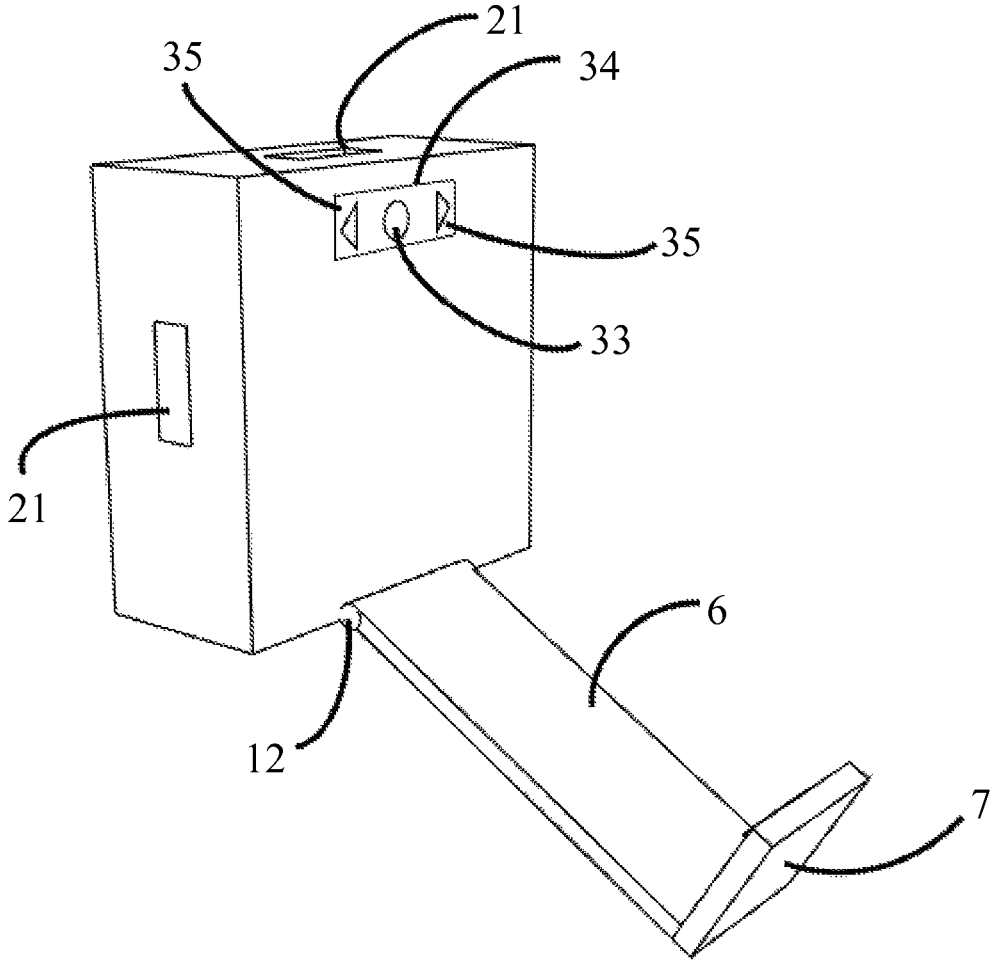
FIG. 7 is a perspective view of control elements on the exterior of the apparatus which may be used to control the power and/or display of the invention.
Figure 8:
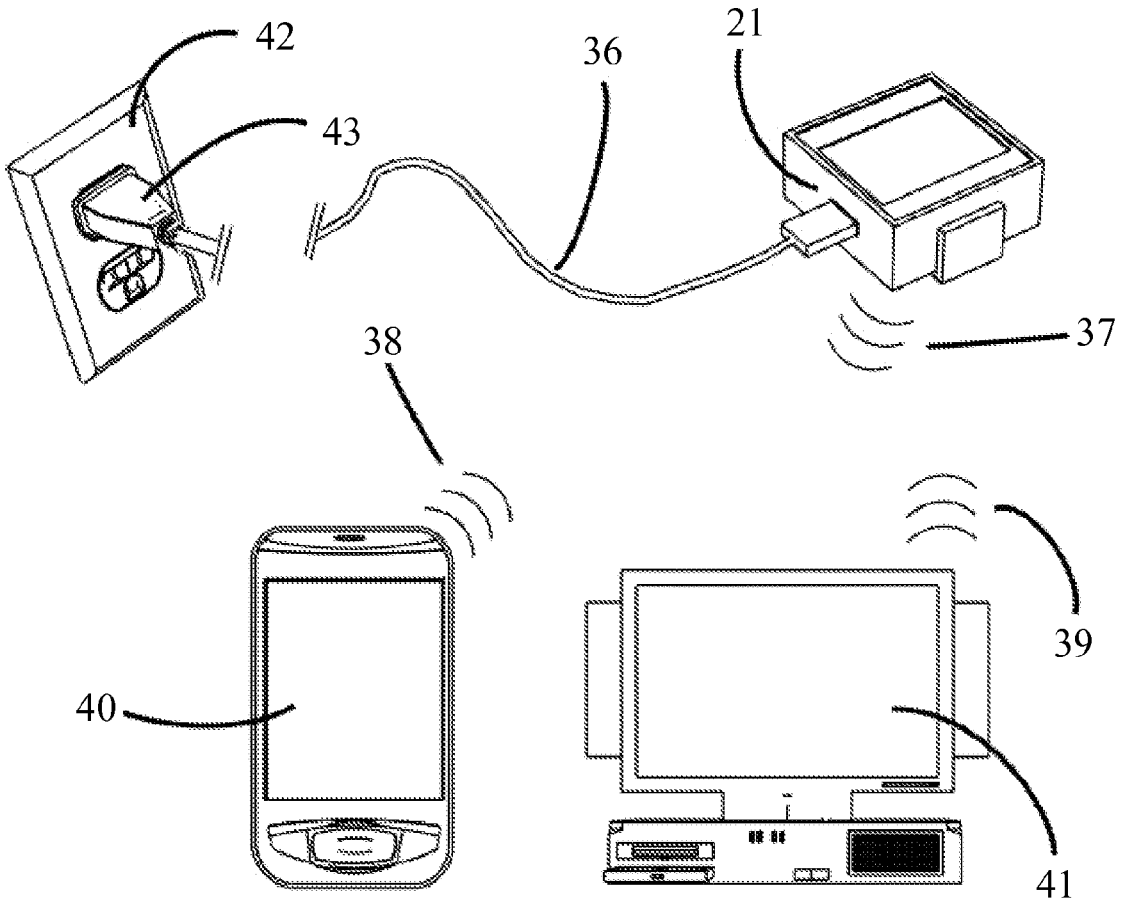
FIG. 8 illustrates the different means by which the apparatus may be charged and/or the power may be monitored.

One or more modular footwear apparatus 1 is designed to attach on to the laces 2 of a shoe 3 or pair of shoes and display images as a reflection of a desired customized display. Each modular footwear apparatus 1 is generally composed of two broad elements an attachment bar element 4 and a display element 5.

The attachment bar 4 is an L-shaped element composed of an applicator section 6 which is attached to a tab section 7. The attachment bar may be made of a sturdy and flexible material, such as plastic or another synthetic material. It should have a thickness dimension 8 such that it provides resistance to bending, cracking or snapping when pressure is applied during it's use. Also, it should have a width dimension 9 such that it is able to be comfortably manipulated with the fingers and covers a broad area of the shoe's tongue when it is inserted below the laces. It's length dimension 10 should be long enough to extend beyond the display device, but close enough to form a connection to it in the display device data receptacle.

At the proximal end 11 of the applicator section 6 of the attachment bar 4 there is a connection to the display element via a hinge 12. In the middle of the applicator section there are two opposing faces, a ventral face 13 and a dorsal face 14. When attached to the footwear, the ventral face is touching the tongue of the shoe, and the dorsal face is touching the laces. At the distal end 15 of the applicator section 6, the section meets and curves into a new vertical tab section forming a 90 degree angle 16 relative to the applicator section 6. The tab section 7 also has two faces, a posterior face 17 that points away from the person using the apparatus and an anterior face 18 that points towards the wearer. The posterior face is smooth and visually integrates with the display element when viewed from a distance. On the anterior face is an angular catch 19, whose hypotenuse 20 faces upwards and towards the wearer. The function of the angular catch 19 is to insert on a data receptacle on the display element and lock the laces between the attachment bar and the display element.

In order to attach the footwear apparatus to the footwear, there is a general progression of steps. They are, (1) insert the attachment bar underneath the laces 2 FIG. 4A, (2) rotate the attachment bar FIG. 4B, (3) push the display element down on the hinge FIG. 4C, such that the angular catch inserts into the receptacle on the display device FIG. 4D. In detail, first one must grasp the attachment bar, putatively with their thumb on the ventral face. Then they must orient the applicator section vertically such that it is roughly perpendicular to the sole of the shoe. Next they must use the tab section 7 and is insert it below one or more of the laces 2. The person can then push the attachment bar in a direction distal (arrow) FIG. 4A to the ankle, progressively encountering more laces. Because of the height of the tab section, multiple laces can accumulate in the rounded corner, between the tab section 7 and the applicator section. Once the desired number of laces has been inserted onto the tab section, the attachment bar is turned 90 degrees (arrow) FIG. 4B in order to turn the tab section vertical. This turning of the attachment bar, spreads the laces out on top of the applicator section and prevents the laces from moving either distally, beyond the tab section 7 or proximally where they will encounter the hinge. After the laces are set on the dorsal face of the applicator section, the display element is swiveled down on top of the laces (arrow) FIG. 4C, until the angular catch snaps into the data receptacle 21. This securely locks the attachment bar to the display device.

When examining a closed apparatus FIG. 4D, the ventral face of the applicator section of the attachment bar touches the tongue of the shoe, the dorsal face of the applicator section touches the laces and the bottom of the display element is above the laces. The apparatus remains closed by the force of the angular catch on the interior face of tab section.

In order to detach the apparatus from the laces the opposite procedure is performed. Although the tab section remains flush or near flush to the top of the display element when the apparatus is in a closed state, the top of the tab section visibly extends from the beveled edge of the display element. This allows a person to easily grab and open the display apparatus. Once the tab section is in the grasp of the wearer, he/she pushes the tab section FIG. 5*a* (arrow) away from their body. This dislodges the angular catch from the receptacle on the display device. Subsequently, the wearer rotates the display element upwards on the hinge FIG. 5*b* (arrow). After rotating the display element upwards, the attachment bar is then also pulled FIG. 5*c* (arrow) such that it becomes vertical in orientation. This can be done by either (1) grasping the proximal portion of the applicator section and pulling upwards or (2) grasping the display device itself and pulling upwards, which due to it's connection to the attachment bar via the hinge, raises the applicator section in a vertical position. Finally, the applicator section can be pulled towards the FIG. 5*d* (arrow) person which will result in the laces sliding back off of the tab section, releasing the apparatus from the shoe.

In a simple embodiment, the display element could be comprised of the following elements; one side of a hinge 22, a back housing 23, a front housing 24, a battery 25, a microprocessor 26, a circuit board 27 which may be attached to one or more USB ports (or other data communication ports for example, fire wire or serial ports). The circuit board may be similarly attached to other functional elements, such as (but not limited to) an electromagnetic wave receiver/transmitter such as bluetooth, infrared, or radio frequency as in an RFID device, an accelerometer, or removable flash memory. This embodiment will include an image display 28, a bezel 29 and a screen 30. One side of the hinge element is attached to the bottom surface of the back housing. The back housing is square in shape and has a notch 31 on any sides that would include a data receptacle 21. This notch 31 forms part of the data receptacle where the angular catch 19 from the tab section 7 of the attachment 4 bar inserts into when the apparatus 1 is in the closed position. The back housing and front housing are both concave such that when combined into a broader housing element, they hold the other elements within their interior space. Also, contained within the housing is one or more batteries 25, that are able to store and release energy. These may be rechargeable or may be one use-type batteries and would include mechanisms, such as removable plates on the housing to replace said batteries. While in this embodiment, the battery is square shaped, it can be of any of the common shapes that are well known in the portable electronic arts. Also surrounded by the housing and on top of the battery is a microcontroller 26. This microcontroller may be programmable, and functions to regulate the display logic and/or process display or synchronization logic. Also contained within the housing is a circuit board 27 that connects the image display 29, battery 25, microcontroller 26, USB ports and other functional elements as described above. The USB or other data communication port element is housed in the receptacle formed by the notches 31 in the front 23 and back housing 24. The image display 29 lies a top the circuit board 27, and is the visual means by which the footwear adornment occurs. The image display 29 can be one of several varieties including light-emitting diode display (LED), an electroluminescent display (ELD), a plasma display panel (PDP), a liquid crystal display (LCD), an HPA display, a thin-film transistor displays (TFT), an organic light-emitting diode displays (OLED), or a surface-conduction electron-emitter display (SED). Finally, the bezel 29 and screen 30 are oriented to fit within inset grooves 32 within the front housing 24.

With regards to managing the power of the apparatus, buttons 33 or switches may be incorporated on the display element to regulate the power. In addition, a circuit can be incorporated into the receptacle 21 and/or on the angular catch 19 to manage the power of the display element. Alternatively, the power to the display element may be regulated by wireless communication with electromagnetic wave transmitter/receiver module on the circuit board of the apparatus via a software program on a computer or mobile phone.

Recharging of the battery can be done by connecting a USB cable 36 to the USB port through the data receptacle 21 and connecting to a power source such as the USB port on a computer. The real time display of the battery life can then be visualized on the image display. The battery charge may be monitored via wireless signal 37 by transmitter/receivers within the housing of the apparatus communicating with transmitter/receiver-mediated electromagnetic signals 39 from computer 41 or signals 38 from a mobile phone 40. Additionally, battery charging can be accomplished by a USB cable 36 hooked up to a home outlet 40 through means of transformer 43 regulating the voltage output. As mentioned above, one-time-use batteries may be used and replaced by incorporating them into the housing of display module through a removable panel.

In order to manipulate the images of the display modules to a persons desired ornamentation, buttons 33, 35 may be included on the apparatuses. These buttons may be contained within a recessed region of the housing 34 on the underside of the display element. In addition, a wireless or USB connection 21 of the display element to a specific software program on a computer or smart phone can be used to manage the display and interaction parameters. One parameter that the software would manage is image display patterns, such as images, shapes, sports team insignias, personal drawings, video clips, photos, text, time, medical information, contact information, logos, and signs. Another parameter that the software may manage is the effects by which these images are displayed such as dissolve, scroll, fade in, fade out, or flash rate. Another parameter is data transfer of files to and from the memory in the display element form memory in the computer. Yet another parameter that the software may manage is the implementation of specific accelerometer based-programs or features. Another parameter that software may manage is the global synchronization-ability of specific modules and their relationships (i.e. how, where, when and with what different modules may be synchronized together and in what manner). This may include the, assigning of specific spatial identities to the modules such as "left" or "right". Another parameter may be designations of events related to a capacitive touch screen present on the display module.

Figure 9:
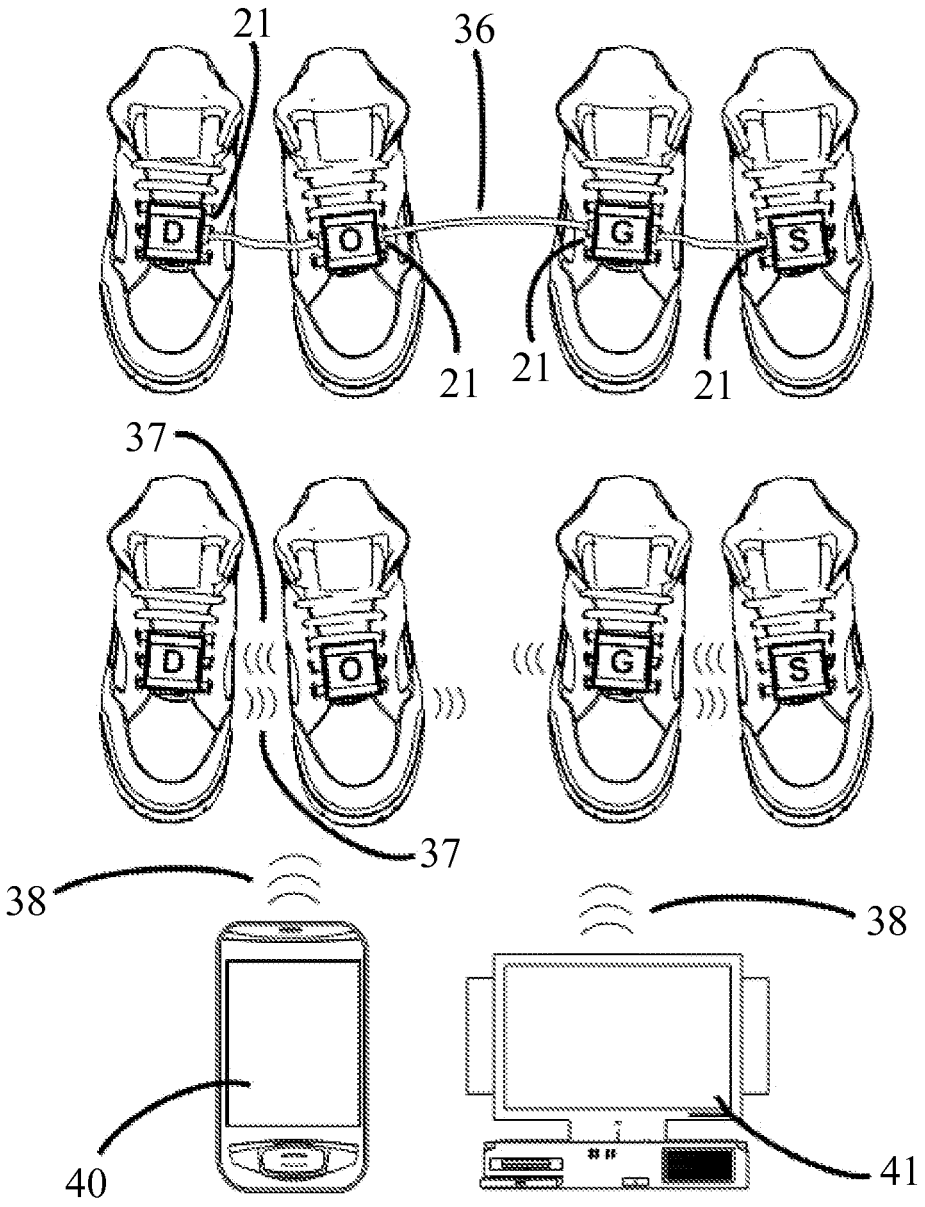
FIG. 9 illustrates means by which synchronization of the image displays may occur between more than one apparatus.

Synchronization between more than apparatus can be accomplished by one or more USB cables 36, attached through opposite side receptacles 21. In addition, the electromagnetic wave receiver/transmitters housed within the apparatus can be used such that real time bi directional signals 37 may occur between more than one apparatus. In this embodiment, the display apparatuses would then interact as modules of a larger and more dynamic visual display. For example, the wearer may display a scrolling "New Orleans" on one device and then a "Hornets" on the other. Or to illustrate another example, an animation of a basketball shot from one display apparatus could land in a hoop on the other apparatus. This synchronization need not only occur between the left and right shoe of a person wearing the modules, but may occur between multiple apparatuses for a larger and more magnified effect. For example, cheerleaders or dancers wearing the apparatus modules, may be able to spell words such as "DOGS" FIG. 9, or blink patterns and effects as part of a choreographic effect. This synchronization may be implemented by a 1 to all signal from a wireless source, such as computer 41 mediated signal 38 or mobile phone 40 mediated signal 38, that starts a predetermined program at the same time. Or there may 1 to or 1 to all communication from the modules themselves to communicate the time synchronization and image display parameters.

In yet another embodiment, an accelerometer element may be included inside the housing of the display module. The accelerometer may monitor the movement of the module, which can be used as a pedometer for tracking gait and running statistics. In addition, dual (or multiple) accelerometers individually housed in synchronized or communicating modules, may be used to track the acceleration based dynamics of a group of modules. One example of a useful function of this embodiment would be track dance steps, when learning a particular type of dance move between the proper motions of the left and right feet. The wearer could be guided by a visual indication on the LCD screen, regarding the accuracy or prowess of the dancer.

In yet another embodiment the display module may include a data storage mechanism, such as flash memory, which may be removable. This memory may include information that is to be displayed on the LCD screen, or may include any information that the wearer deems important to carry (i.e contact information, medical information, or files). Additionally, this memory may be accessed by blue tooth, physical removal (such as an SD-card), USB or by other modules. Further, this embodiment may allow some data storage information deemed "public" by the wearer to be publicly broadcast via blue tooth to other near by modules.

In yet another embodiment, the display element may be incorporated with a capacitive touchscreen, which may act to regulate the image display parameters in some manner. This touch screen may also act to turn on or off the device, enable or disable data transfer, or regulate synchronization or wireless parameters.

I claim:

1. A footwear apparatus for customizing a footwear, the footwear apparatus comprising: an electronic display housing and a hooked latch, wherein said hooked latch is integrally connected to the electronic display housing by a hinge on a first side of the electronic display housing, wherein said electronic housing comprises a battery, a microprocessor, a circuit board, a data port, and an image display that uses visible radiant energy to make a footwear visible; wherein said hooked latch comprises an L-shaped bar including a sliding portion with a substantially smooth and flat top surface, wherein said sliding portion has a greater length than a width, wherein said width of the sliding portion is less than a width of the electronic display housing to allow a more effective way of rapidly and securely attaching and detaching the electronic display housing to a lace of the footwear; wherein said sliding portion, is integrally connected to a tab portion forming an angle of greater than 45 degrees; wherein said tab portion has a substantially flat inner and an outer surfaces, wherein said inner surface further comprises a first catch portion that removably attaches to a second catch portion on a second opposite side of said electronic display housing for securely fastening the footwear apparatus to the footwear.

2. The footwear apparatus of claim 1, wherein said image display is selected from the group consisting of a light emitting diode display (LED), an electroluminescent display (ELD), a plasma display panel (PDP), a liquid crystal display (LCD), a thin-film transistor display (TFT), an organic light emitting diode display (OLED), a capacitive touch screen, and a surface conduction electron emitter display (SED).

3. The footwear apparatus of claim 2, wherein said electronic display housing further comprises one or more data communication devices that are selected from the group consisting of an electromagnetic wave receiver, an electromagnetic wave transmitter, and blue tooth.

* * * * *